US006782558B1

(12) United States Patent
Keen, Sr. et al.

(10) Patent No.: US 6,782,558 B1
(45) Date of Patent: Aug. 31, 2004

(54) LIGHTWEIGHT WRESTLER HEADGEAR

(75) Inventors: James C. Keen, Sr., Dexter, MI (US); John L. Marchello, Ann Arbor, MI (US)

(73) Assignee: Cliff Keen Wrestling Products, Inc., Ann Arbor, MI (US)

( * ) Notice: Subject to any disclaimer, the term of this patent is extended or adjusted under 35 U.S.C. 154(b) by 140 days.

(21) Appl. No.: 10/236,047

(22) Filed: Sep. 5, 2002

Related U.S. Application Data

(60) Provisional application No. 60/317,265, filed on Sep. 5, 2001.

(51) Int. Cl.[7] ..... A63B 71/10; A42B 7/00

(52) U.S. Cl. ..... 2/425; 2/421

(58) Field of Search ..... 2/421, 425, 423, 2/209

(56) References Cited

U.S. PATENT DOCUMENTS 3,327,316 A * 6/1967 Pukish, Jr. ..... 2/421
4,539,715 A * 9/1985 Clement ..... 2/420
5,685,021 A * 11/1997 Tsujino ..... 2/425
5,898,950 A * 5/1999 Spyrou et al. ..... 2/421
6,418,565 B1 * 7/2002 Tsujino ..... 2/425
6,557,186 B1 * 5/2003 Purnell ..... 2/425
6,564,395 B2 * 5/2003 Keen ..... 2/425

* cited by examiner

*Primary Examiner*—Rodney M. Lindsey
(74) *Attorney, Agent, or Firm*—James M. Deiman

(57) ABSTRACT

New lightweight wrestler headgear comprises an inner soft plastic cushion for contact with the wearer and an outer hard shell having a plurality of swirling or sweeping curved protrusions intended to suggest the swirling clouds of a tornado. In the depressions or valleys between the swirls are a large number of vent holes that effectively remain uncovered for good hearing regardless of the activity during a wrestling match. The inner cushion and outer shell are peripherally shaped with concave outer edges between locations where straps are attached to the inner cushion and outer shell. Because of the novel peripheral shapes and the protruding swirls the outer shell can be made exceptionally light and strong with little impairment of hearing.

13 Claims, 2 Drawing Sheets

LIGHTWEIGHT WRESTLER HEADGEAR

BACKGROUND OF THE INVENTION

This application claims the benefit of provisional patent application No. 60/317,265, filed Sep. 5, 2001.

The field of the invention pertains to the sport of wrestling and, in particular, to protective headgear worn by participants. The protective headgear is primarily directed to prevention of damage to the ear pinnae. The first such headgear specifically for the protection of wrestlers' ears was disclosed in U.S. Pat. No. 2,898,596 and has been very successfully used in collegiate wrestling.

In subsequent years, a variety of protective headgear has been patented, all sharing in common with the above patent relatively rigid ear coverings held in place by a plurality of straps. The straps are adjustable and generally pass over the head, behind the head and over or under the chin.

U.S. Pat. No. 3,311,921 discloses single piece plastic ear coverings with the straps riveted thereto. A plurality of several small holes and a larger hole pierce the ear covering to prevent entrapment of stale air and assist in hearing.

U.S. Pat No. 3,327,316 discloses ear coverings having a single hole and a passageway relatively close to the wearer's face. In theory the configuration prevents over-pressure or partial vacuum conditions from occurring in the ear canal during wrestling.

U.S. Pat. No. 3,513,482 discloses an ear covering with the straps passing through slots in the periphery of the ear covering and small holes near the center of the ear covering.

U.S. Pat. No. 3,596,288 discloses straps that are integral with the ear coverings as distinguished from the previous patent above which utilizes slots for the straps, the slots being formed in the ear coverings.

U.S. Pat. No. 4,551,861 discloses a construction of the ear covering simplified for more economical manufacture by making the ear pad from a single sheet of soft resilient plastic.

U.S. Pat. No. 4,710,985 discloses an ear covering of substantially triangular shape with small vent holes and three straps including the chin strap.

U.S. Pat. No. 4,821,345 discloses a multiple layer ear cover having a metal reinforcing plate as one of the interior layers and to which the straps are attached. Various features are disclosed to reduce the tendency of the molded plastic parts of the ear cover to tear.

U.S. Pat. No. 5,504,945 discloses an ear cover having a molded flexible outer cover with a plurality of apertures and a foam pad beneath the outer cover that protrudes through the apertures. The protruding foam is provided for added protection to both the user and his opponent.

U.S. Pat. No. 5,685,021 discloses an ear cover having a gel cushioning layer and a tacky exterior surface to grip the area surrounding the wrestler's ear. In using all of the above wrestling headgear, the headgear must be removed from the head to adjust the straps. Proper adjustment is therefore time consuming and tedious. The adjustment elements in the above patents are made a part of the ear cover and when tight to the head cannot be easily loosened or tightened.

U.S. Pat. No. 5,881,393 discloses substantially triangular ear covering with cloth covered foam on the inside having a specific shape for engagement with the wearer. Hollow rivets form vent holes in the ear covering.

SUMMARY OF THE INVENTION

The new lightweight headgear ear coverings comprise an inner soft plastic cushion construction for contact with the wearer and an outer hard shell having a plurality of swirling or sweeping curved protrusions intended to suggest the swirling clouds of a tornado. In the depressions or valleys between the swirls are a large number of vent holes that effectively remain uncovered for good hearing regardless of the activity during a wrestling match.

The outer hard shell and inner cushion are retained together by the straps and chin strap snap fasteners with a chin pad mounted on the chin strap. The inner cushion and outer shell are peripherally shaped with concave outer edges between locations where straps are attached to the inner cushion and outer shell. Because of the novel peripheral shapes and the protruding swirls the outer shell can be made exceptionally light and strong with little impairment of hearing. The chin pad is also formed with top and bottom edges concave to avoid the lower lip and save weight, the result being a headgear up to 30% lighter than previous wrestler headgear and up to 70% cooler.

DESCRIPTION OF THE PREFERRED EMBODIMENT

Figure 1:
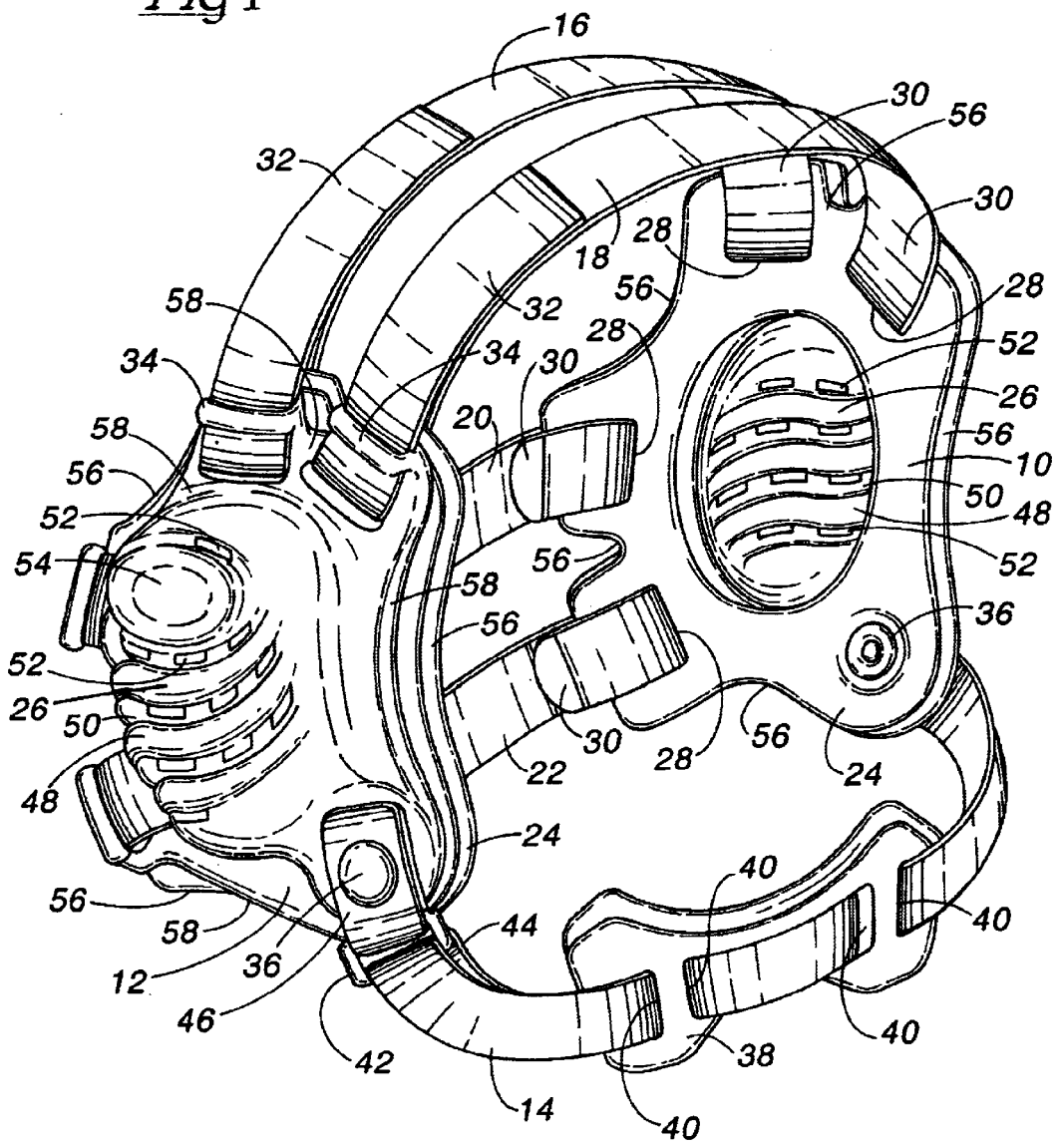
FIG. 1 is a perspective view of the new headgear.

Illustrated in FIG. 1 is the new headgear comprising left 10 and right 12 ear covers, a chin strap 14, a pair of over the head straps 16 and 18 and a pair of behind the head straps 20 and 22. Each ear cover 10 or 12 has a soft inner cushion 24 and a stiff outer hard shell 26.

Slots 28 penetrate both the cushion 24 and shell 26 and the straps 16, 18, 20 and 22 pass through the slots 28 as shown to retain the cushion 24 to the shell 26. The straps 16, 18, 20 and 22 are equipped with hook and loop fasteners toward both the ends of each strap with the short ends 30 wrapped under on the left 10 ear cover. The long adjustable ends 32 of the straps 16, 18, 20 and 22 are wrapped over for ease of adjustment with the headgear on the user. The adjustable ends 32 pass through flattened loops 34 on the right 12 ear cover.

Figure 2:
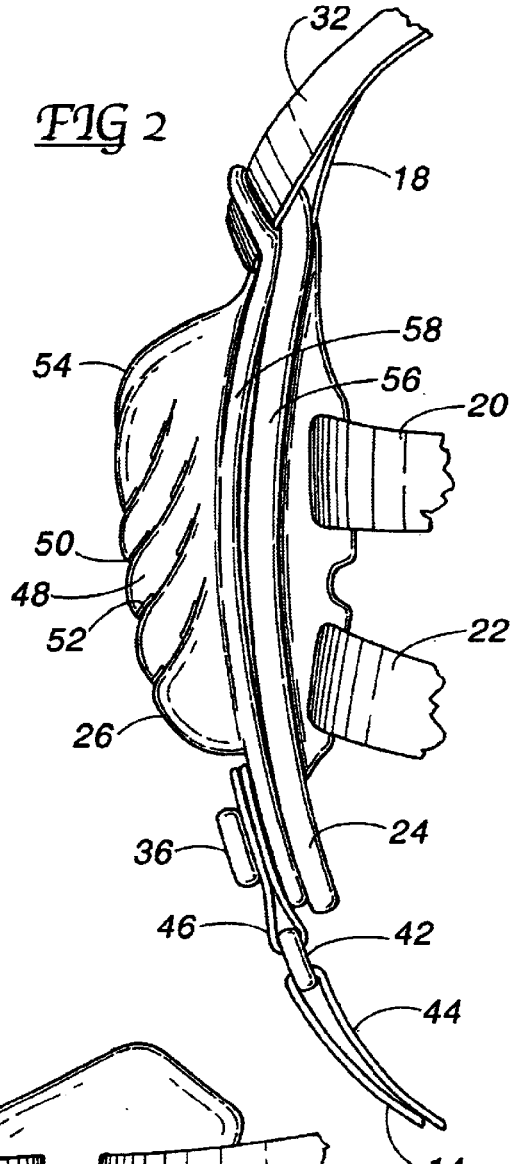
FIG. 2 is a partially cutaway edge view of one ear cover.
Figure 3:
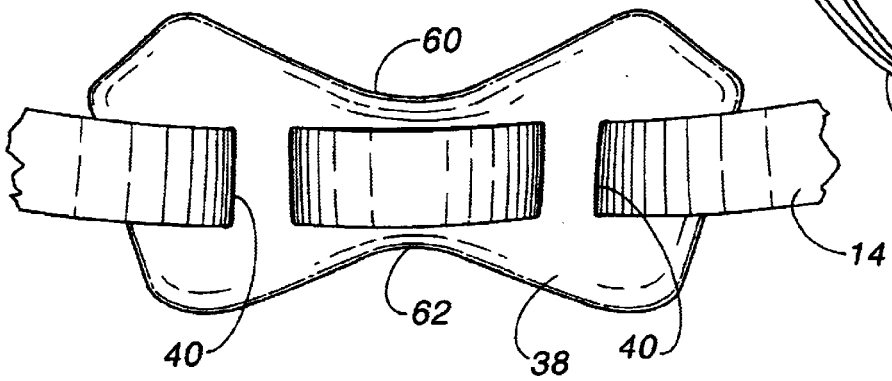
FIG. 3 is a cutaway front view of the chin strap.

The chin strap 14 is retained to left 10 and right 12 ear covers by snap fasteners 36 permitting the chin strap to be removed from either or both ear covers. The male portion of each snap fastener 36, however, may permanently fasten together the soft inner cushion 24 and stiff outer hard shell 26 for each ear cover 10 or 12, or, in the alternative, the snap fastener may only be permanently fastened to the hard shell with a hook and loop fastener joining the soft inner cushion to the hard shell at that location. On the chin strap 14 is a cushioned chin pad 38 also shown in FIG. 3 having a plurality of slots 40 through which the chin strap is threaded. The chin strap 14 is adjusted by means of the clip 42 and looped over portion 44 of the strap fastened with hook and loop fasteners. A separate short portion 46 of the chin strap 14 joins the clip 42 to the snap fastener 36 on the right ear cover 12 as shown in FIG. 2.

The stiff outer hard shell 26 is formed with swirling or sweeping ridges 48 separated by grooves 50. Located within the grooves are a plurality of vent holes in the form of slots 52 that fully penetrate the shell 26. As best shown in FIG. 2, the shell 26 is deeply cupped 54 to provide clearance for the wearer's ear. The combination of the deeply cupped shape 54 with the swirling ridges 48 provides an exceedingly strong geometric configuration for the shell 26, which, in turn, allows the shell to be made of relatively thin plastic yet retain great rigidity. The thin plastic allows some flexibility in the shell 26 outside of the deeply cupped shape 54 where the straps connect the shell to the cushion 24.

The slots 52 are relatively numerous comprising about 18 or 19. Being depressed in the grooves 50, they generally remain open, even when the ear cover 10 or 12 is otherwise covered during a match. Thus, hearing is not impaired nor is cooling of the air about the ear. The swirling ridges 48 also lend an attractive appearance to the shells 26 implying or suggesting a tornado and providing an attractive location 54 for a logo.

The soft inner cushion 24 and hard shell 26 are recessed and concave along their respective peripheries between strap attachments as shown at 56 for the cushion and 58 for the shell. The recesses save weight and provide for better air circulation by lessening the coverage of the wearer's scalp. Likewise, the chin pad 38 is recessed on top 60 and below 62 to better fit between the chin and lower lip of the wearer.

What is claimed is:

1. Wrestler headgear comprising right and left ear covers, said ear covers each comprising a relatively soft inner cushion and a relatively stiff outer shell, and each shell having a deeply cupped portion formed with a plurality of swirling ridges spaced by swirling grooves therebetween.

2. The wrestler headgear of claim 1 wherein the grooves are penetrated by a plurality of slots.

3. The wrestler headgear of claim 1 wherein the periphery of each cushion includes a plurality of recesses thereabout.

4. The wrestler headgear of claim 1 including a chin pad and wherein the periphery of the chin pad includes at least one recess.

5. The wrestler headgear of claim 1 including a plurality of straps, said straps attaching each cushion to the corresponding shell and each strap having the long adjustable end thereof wrapped over the strap.

6. Wrestler headgear comprising right and left ear covers, said ear covers each comprising a relatively soft inner cushion and a relatively stiff outer shell, and each shell having a deeply cupped portion formed with a plurality of ridges spaced by grooves therebetween.

7. The wrestler headgear of claim 6 wherein the grooves are penetrated by a plurality of slots.

8. The wrestler headgear of claim 6 wherein the periphery of each cushion includes a plurality of recesses thereabout.

9. The wrestler headgear of claim 6 wherein at least one of the grooves is penetrated by a plurality of slots.

10. The wrestler headgear of claim 8 including a pair of over the head straps and recesses between the pair of over the head straps.

11. The wrestler headgear of claim 8 including a pair of behind the head straps and recesses between the pair of behind the head straps.

12. The wrestler headgear of claim 8 wherein the periphery of each outer shell substantially follows the curvature of the periphery of the corresponding cushion attached thereto.

13. The wrestler headgear of claim 6 including a chin pad and wherein the periphery of the chin pad includes at least one recess.

* * * * *